US006574890B2

(12) United States Patent
Bateman, Jr.

(10) Patent No.: US 6,574,890 B2
(45) **Date of Patent: *Jun. 10, 2003**

(54) COMBINATION SNOWPLOW AND BUCKET

(75) Inventor: Donald A. Bateman, Jr., St. Paul, MN (US)

(73) Assignee: Bateman Services, Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/549,484

(22) Filed: Apr. 14, 2000

(65) Prior Publication Data

US 2002/0092211 A1 Jul. 18, 2002

Related U.S. Application Data

(60) Provisional application No. 60/131,639, filed on Apr. 15, 1999.

(51) Int. Cl.[7] ..... E01H 5/04

(52) U.S. Cl. ..... 37/264; 37/444; 172/817

(58) Field of Search ..... 37/264, 266, 241, 37/253, 411, 444, 443, 407, 408, 409; 72/810, 811, 817

(56) References Cited

U.S. PATENT DOCUMENTS

| | | | | |
|---|---|---|---|---|
| 1,937,243 A | * | 11/1933 | Pearch | |
| 2,674,052 A | * | 4/1954 | Newkirk | |
| 2,778,129 A | * | 1/1957 | Fryer | 37/449 |
| 2,828,558 A | * | 4/1958 | Reinhard | 37/449 |
| 3,085,832 A | * | 4/1963 | Guillemette | |
| 3,934,654 A | * | 1/1976 | Stephenson et al. | |
| 4,058,173 A | * | 11/1977 | Carson | |
| 4,306,362 A | * | 12/1981 | Waterman | |
| 4,707,936 A | * | 11/1987 | Steinhoff | 37/264 |
| 4,991,662 A | * | 2/1991 | Caron et al. | |
| 5,253,449 A | * | 10/1993 | Webb et al. | 37/446 |
| 5,487,428 A | * | 1/1996 | Yamamoto et al. | |
| 5,513,453 A | * | 5/1996 | Norton | 37/244 |
| 5,611,157 A | * | 3/1997 | Ferreira | 37/449 |
| 5,741,112 A | * | 4/1998 | Lakin et al. | 414/722 |
| 6,125,559 A | * | 10/2000 | Mullenhour | |
| 6,134,813 A | * | 10/2000 | Vickers | |

OTHER PUBLICATIONS

Declaration of Donald A. Bateman, Jr., including four photographs of truck–mounted snowplows in public use prior to Apr. 15, 1999.

* cited by examiner

*Primary Examiner*—Victor Batson
(74) *Attorney, Agent, or Firm*—Kinney & Lange, P.A.

(57) ABSTRACT

The present invention is a combination snowplow and bucket for attachment to a vehicle for the purposes of plowing, scooping, transporting and dumping snow. The present invention is a curved plow member having a concave plow face. The concave plow face has a center portion and first and second side portions extending from the center portion. The first and second side portions are inwardly bent toward the center portion. The present invention also has a generally planar bottom plate affixed to the plow member. The bottom plate has a scraper edge that extends from the first side portion to the second side portion. The center portion, the first and second side portion and the bottom plate collectively define a bucket used to transport the snow. Alternately, a wear plate can be affixed to the underside of the bottom plate.

15 Claims, 3 Drawing Sheets

COMBINATION SNOWPLOW AND BUCKET

CROSS REFERENCE TO RELATED APPLICATION

This application claims priority from provisional U.S. patent application Ser. No. 60/131,639, filed on Apr. 15, 1999 for "Snowplow/Bucket Apparatus" by Donald A. Bateman, Jr.

BACKGROUND OF THE INVENTION

The present invention relates to snow removal equipment. In particular, the present invention relates to snowplows for moving snow away from a paved surface, such as a roadway, parking lot, walkway, or driveway.

Snow removal is serious business. When snow falls and accumulates, people rely on diligent snow removal technicians to quickly remove the snow from the roads, walkways, driveways, and parking lots that connect everyone to their schools, places of business, local grocery stores, etc. Only a few inches of fresh snow can shut down an entire city, costing businesses untold amounts of money.

The tool of choice for moving large amounts of snow has been the ubiquitous snowplow. Typically, a snowplow is a metal member curved inwardly to define a concave plow face for directing snow away from a surface. The snow plow is usually attached to the front of a truck or other multi-purpose vehicle. The truck pushes the snowplow along the surface to be cleared of snow. As the snowplow advances, snow is directed toward one or both sides of the snowplow. This action creates windrows (heaps of snow) on one or both sides of the plow. Thus it is usually necessary to make a second pass along the same surface to clear the remaining windrows from the surface.

In many instances removing the heaped snow to another area is necessary. Simply pushing the snow off to the side with a conventional snowplow may not do an adequate job of clearing snow in some circumstances. Examples of such circumstances include narrow streets without generous shoulders on which to pile the snow, or parking lots where space is at a premium. A second snow removal tool, such as a shovel or bucket must be used to pick the snow up and take it away from the area to be cleared. In the past, carrying snow away required using a second truck having a separate shovel tool, or exchanging the snowplow for a shovel to complete the snow removal.

BRIEF SUMMARY OF THE INVENTION

The present invention is a combination snowplow and bucket for attachment to a vehicle for the purposes of collecting, transporting and dumping snow. The snowplow bucket of the present invention has a curved plow member with a top edge and a bottom edge, and which defines a concave plow face. The concave plow face has a center portion and first and second side portions extending laterally from the center portion. Each side portion is aligned at an obtuse angle relative to the center portion. The snowplow bucket of the present invention also has a generally planar bottom plate affixed to the plow member. The bottom plate has a rear edge and a forward edge. The bottom plate is affixed to the curved plow member adjacent the rear edge of the bottom plate, and the forward edge of the bottom plate defines a scraper edge that is generally vertically aligned under the top edge of the center portion of the plow member. The center portion, first and second side portions and the bottom plate collectively define a bucket used to transport the snow.

The present invention can both push snow away from a surface and carry snow away from the plowed surface. The combination snowplow and bucket includes a concave plow member having inwardly bent side portions. The bent side portions are angled inwardly toward the center of the plow member. A generally semicircular or trapezoidal bottom plate is attached to the plow member. A curved inner surface of the plow member with the bent side portions and the attached bottom plate define a bucket in which snow may be collected and carried. Besides defining part of a snow-carrying bucket, the inwardly bent ends of the plow member inhibit snow from spilling out on either or both sides of the plow as it is urged forward, thereby reducing windrows.

The present invention thus provides the advantage of a tool that can both clear snow and carry snow away from the surface to be cleared. The present invention provides a snowplow and bucket which would increase snow removal efficiency by eliminating the need to use more than one tool or vehicle to remove snow. The present invention is a snow removal tool that reduces the amount of snow that spills out from the tool creating windrows adjacent the cleared surface. The present invention also provides a snow removal tool that can be pushed forwardly into contact with a wall or other support structure and can then lift the snow adjacent to the wall or support structure in the bucket without spilling the snow.

BRIEF DESCRIPTION OF THE DRAWINGS

The present invention will be further explained with reference to the drawing figures listed below, wherein like structure is referred to by like numerals throughout the several views.

Figure 1:
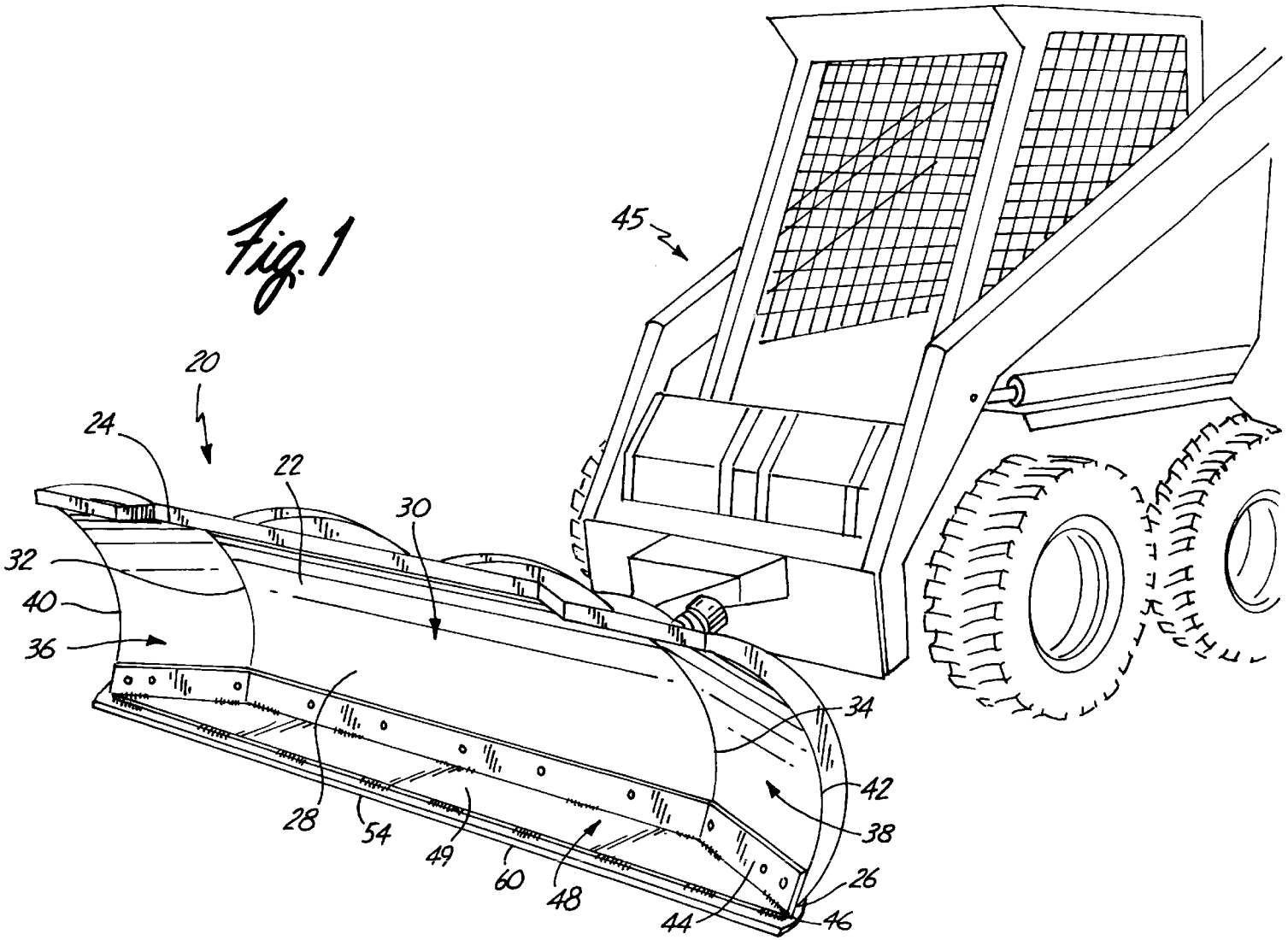
FIG. 1 is a front perspective view of the combination snowplow and bucket of the present invention, as mounted for use on a front-end loader.
Figure 2:
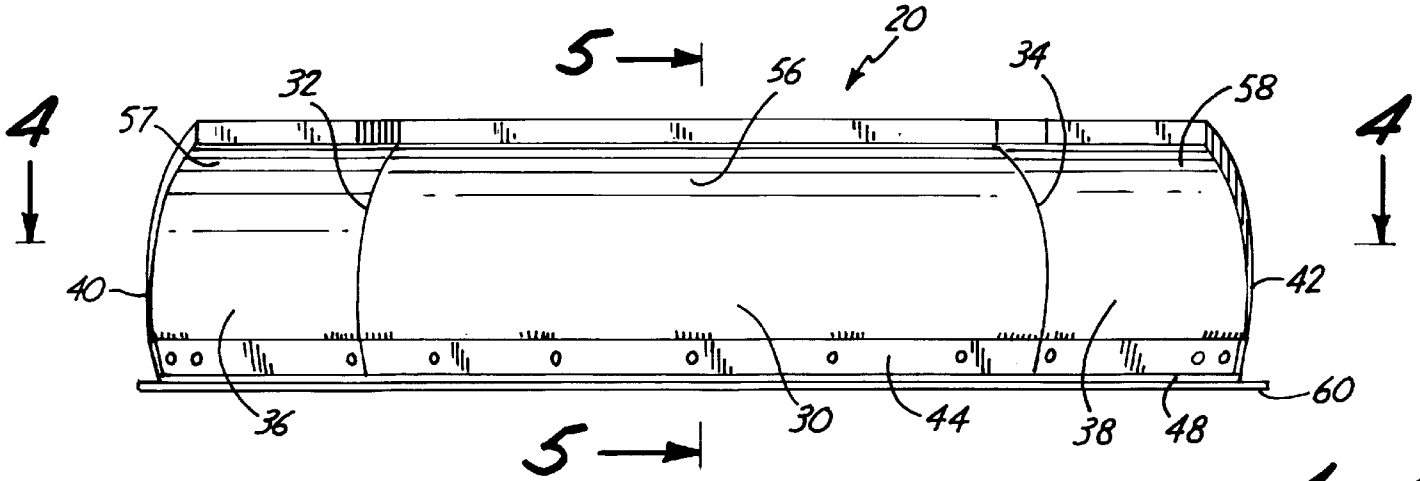
FIG. 2 is a front elevational view of the combination snowplow and bucket of the present invention.

While the above-identified drawing figures set forth one preferred embodiment of the invention, other embodiments are also contemplated, as noted in the discussion. In all cases, this disclosure presents the present invention by way of representation and not limitation. It should be understood that numerous other modifications and embodiments can be devised by those skilled in the art which fall withing the scope and spirit of the principles of this invention.

DETAILED DESCRIPTION

A preferred embodiment of a combination snowplow and bucket 20 according to the present invention is shown in FIGS. 1–5. The snowplow and bucket 20 includes a plow member 22 curved from a top edge 24 to a bottom edge 26 to define a concave plow face 28. The plow member 22 has a center portion 30. The center portion 30 has opposed first 32 and second 34 side edges extending between the top 24 and bottom 26 edges.

Figure 3:
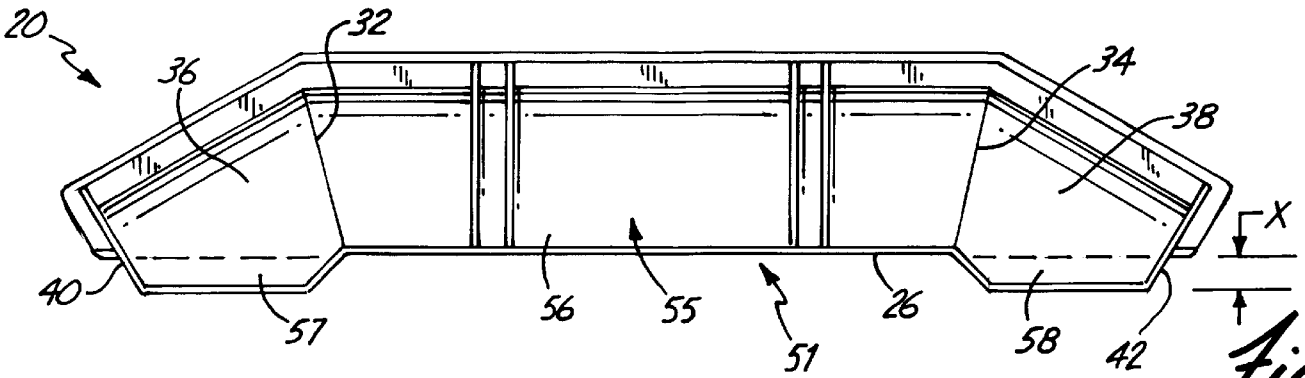
FIG. 3 is a top view of the combination snowplow and bucket of the present invention.
Figure 4:
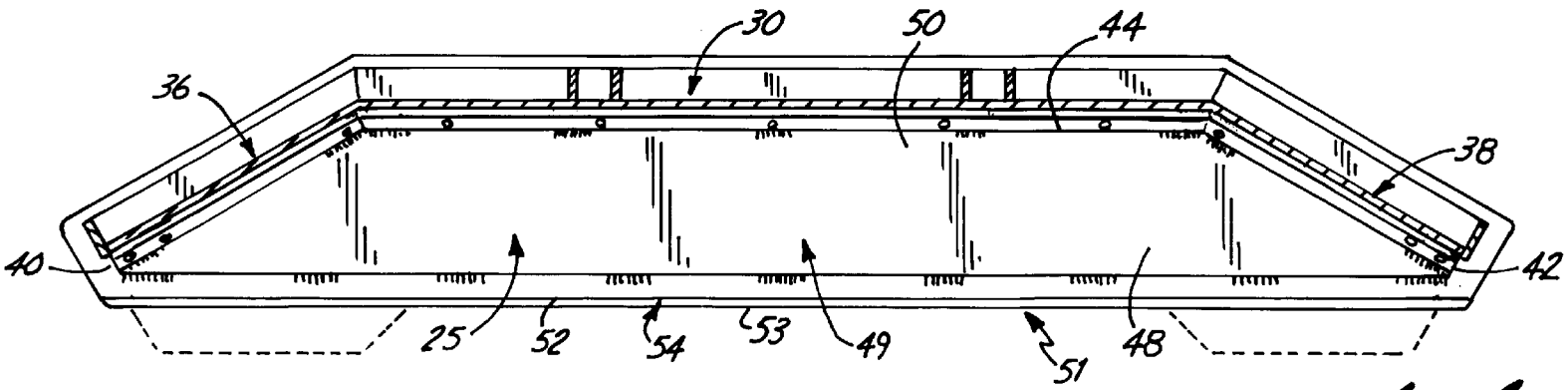
FIG. 4 is a sectional view taken along line 4—4 of FIG. 2.

The plow member 22 has a right side portion 36 and a left side portion 38. The right side portion 36 has a right side edge 40 and the left side portion 38 and has a left side edge 42. As best seen in FIG. 4, the right side portion 36 extends laterally from the first side edge 32 and defines a right portion of the concave plow face 28 which is generally aligned at an obtuse angle relative to the center portion 30. The left side portion 38 extends laterally from the second side edge 34 and defines a left portion of the concave plow face 28 which is generally aligned at an obtuse angle relative to the center portion 30. As shown in FIG. 3, the top edge 24 extends across the center portion 30 and side portions 36 and 38, with those sections of the top edge 24 in the right and left side portions 36, 38 being preferably generally parallel to the section of the top edge 24 along the center portion 30.

Figure 5:
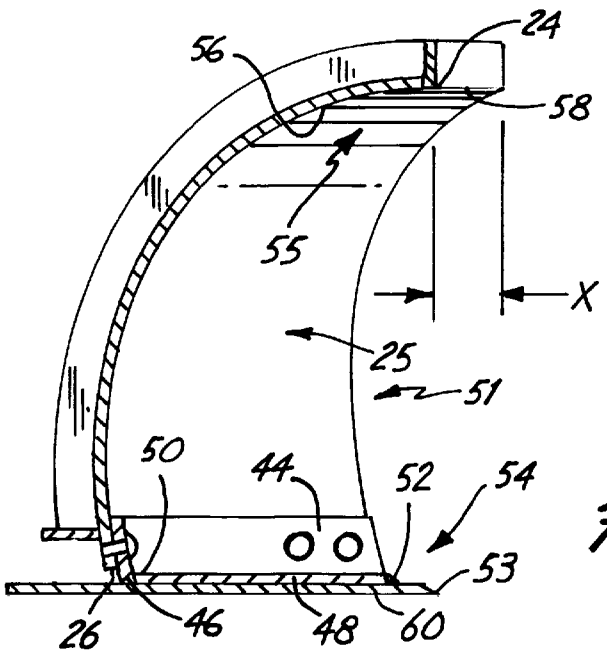
FIG. 5 is a sectional view taken along line 5—5 of FIG. 2.

The plow member 22 has a flange portion 44 fixedly secured to the plow face 28 adjacent the bottom edge 26 thereof. The flange portion 44 can be fixedly secured to the plow face by any suitable method, such as by riveting or welding. The flange portion 44 extends substantially along the length of the plow face 28 from the right side edge 40 to the left side edge 42. The flange portion 44 is fixedly secured to the plow face 28 such that substantially all of the flange portion 44 is adjacent to the plow face 28. As seen in FIG. 5, a lower section of the flange portion 44 extends slightly beyond the bottom edge 26 to a flange bottom edge 46.

A generally planar bottom plate 48 has a rear edge 50 and a forward edge 52. The bottom plate rear edge 50 is attached (i.e., welded) to the flange bottom edge 46. The bottom plate rear edge 50 extends between the right side edge 40 and the left side edge 42 along the flange bottom edge 46. The forward edge 52 defines a scraper edge 54, which is preferably linear but can be of any desired shape. The scraper edge 54 is aligned generally vertically under that section of the top edge 24 in the center portion 30 of the plow member 22.

The bottom plate 48 has a continuous inner surface 49 that connects the inwardlybent side portions 36, 38 of the plow member 22, and is oriented to extend from the center portion 30 of the plow member 22 out to the inwardly bent side portions 36, 38. The inner surface 49 of the bottom plate 48, the concave plow face 28 of the plow member 22, and the bent side portions 36, 38 collectively define a bucket 25 having an open end 51 for collecting and carrying snow (see FIGS. 3 and 5).

The concave plow face 28 has an upper portion 55 adjacent the top edge 24 of the plow member 22, which is generally parallel to the bottom plate 48 (see FIG. 5). The upper portion 55 includes an upper portion 56 of the center portion 30, and the right and left side portions each have an upper portion 57, 58, respectively. As seen in FIGS. 3 and 5, the upper portions 57, 58 extend the top edge 24 of each side portion beyond the forward edge 52 of the bottom plate 48 by a distance "X".

In a preferred embodiment, a wear plate 60 is affixed on the outside (underside) of the bottom plate 48 and is generally the same size and shape of the bottom plate 48. The wear plate 60 has a front edge 53 (FIG. 5) that extends beyond the forward edge 52 of the bottom plate 48 to define the scraper edge 54. Alternatively the front edge 53 is co-linear with the forward edge 52, and thus the scraper edge 54 is defined by both the forward edge 52 of the bottom plate 48 and the front edge 53 of the wear plate 60. When provided, the wear plate 60 contacts the snow covered surface while the snow plow is advanced to clear the snow. Because the wear plate 60 is in contact with the surface it prevents damage to the bottom plate 48.

The combination snowplow and bucket 20 of the present invention is preferably formed of a metallic material, such as steel or aluminum. The bottom plate 48 is preferably fastened to the plow member 22 in a manner to allow easy removal and replacement.

As best seen in FIG. 1, the combination snowplow and bucket 20 of the present invention is attached by means well known in the art to the front of a truck or multi-purpose vehicle, such as the BOBCAT™ front-end loader 45 from Melroe Corporation, Fargo, N. Dak. The front-end loader 45 has the ability to articulate and manipulate the snowplow and bucket 20. The range of motions include tilting the snowplow and bucket 20 side-to-side, movement up and down, and rotation of the bucket on horizontal and vertical axes, and/or any combination thereof.

As the combination snowplow and bucket 20 is pushed along the snow covered surface, the bottom plate 48 is typically generally horizontally configured and slides along the snow covered surface as the combination snowplow and bucket 20 is urged forward. As the combination snowplow and bucket 20 of the present invention is pushed forward, a certain amount of snow collects within the bucket 25, rather than spilling to the slide of the combination snowplow and bucket 20. In addition, snow may be scooped and carried within the bucket 25.

To carry snow away from a location, the combination snowplow and bucket 20 is raised and tilted by the front end loader 45 so that the bottom plate 48 is generally perpendicular to the snow covered surface and the open end 51 of the combination snowplow and bucket 20 is facing away from the plowed surface. The snow collected can then be carried away from the plowing surface. To deposit the collected snow in a particular location, the combination snowplow and bucket 20 is tilted so that the open end 51 is directed downward. All of these functions (plowing, scooping, transporting and dumping) can be performed with the present invention, thereby eliminating the need to bring more than one snow removal tool to a work site.

The combination snowplow and bucket 20 of the present invention can both plow snow and carry snow away. When the combination snowplow and bucket 20 of the present invention is used, there is no need for a plow operator to carry another tool or to stop to exchange a plow tool for a bucket tool on the snow removal vehicle. As a result, the combination snowplow and bucket 20 of the present invention significantly increases the efficiency of snow removal.

Although the present invention has been described with reference to a preferred embodiment, workers skilled in the art will recognize that changes may be made in form and detail without departing from spirited scope of the invention. For example, the angled end portions of the plow member may be aligned at different angles from one another or the center portion 30. Similarly, the bottom plate may be any number of shapes including triangular, trapezoidal, or semicircular. The bottom plate and plow member may be formed from one piece or a plurality of pieces. The scraper edge may include the use of tines. The bottom plate may be fastened to the plow member in any number of ways including with adhesives, rivets, bolts, welding or a combination these. Further, the plow member may be semicircular in shape rather than having discrete angled corners where the angled end portions meet the plow member. Another design variation would be to set back the scraper edge 54 from the front edge 24 so that they are not aligned generally vertically.

I claim:

1. A snowplow bucket for attachment to a vehicle comprising:

a curved plow member having a top edge and a bottom edge defining a concave plow face, the curved plow member having a center portion which has opposed first and second side edges extending between the top and bottom edges, a right side portion extending laterally from the first side edge of the center portion and aligned at an obtuse angle relative to the center portion, a left side portion extending laterally from the second side edge of the center portion and aligned at an obtuse angle relative to the center portion; wherein the top edges of the center portion and side portions are generally parallel; and a generally planar bottom plate having a rear edge and a forward edge, the bottom plate being affixed to the curved plow member adjacent the rear edge of the bottom plate and the forward edge defining a scraper edge which is aligned generally vertically under the top edge of the center portion of the plow member.

2. The snowplow bucket of claim 1 wherein the top edge of each side portion of the plow member extends beyond the top edge of the center portion of the plow member.

3. The snowplow bucket of claim 1 wherein the bottom plate has a wear plate affixed on an outer side thereof.

4. The snowplow bucket of claim 3 wherein the forward edge of the bottom plate is defined by an edge of the wear plate.

5. The snowplow bucket of claim 1 wherein the scraper edge is linear.

6. The snowplow bucket of claim 1 wherein the concave plow face has an upper portion adjacent the top edge of the plow member, which is generally parallel to the bottom plate.

7. The snowplow bucket of claim 1, and further comprising a bottom flange fixedly secured to the plow face adjacent the bottom edge of the plow member, and the bottom plate being affixed to the bottom flange.

8. A snowplow bucket for an attachment to a vehicle comprising:

a plow member comprising:

a center plow surface, the center surface defined by a top edge, a bottom edge, and opposed first and second side edges extending between the top and bottom edges;

a left side portion extending laterally from the first side edge of the center surface, the left side portion aligned at an obtuse angle relative to the center surface, and the left side portion having a top edge and a bottom edge; and a right side portion extending laterally from the second side edge of the center surface, the right side portion aligned at an obtuse angle relative to the center surface, and the right side portion having a top edge and a bottom edge; and a generally planar bottom having a rear edge and a forward edge, the bottom plate being affixed to the plow member adjacent the rear edge of the bottom plate and the foward edge defining a scraper edge.

9. The snowplow bucket member of claim 8 wherein the top edge of each side portion of the plow member extends beyond the top edge of the center surface of the plow member.

10. The snowplow bucket of claim 8 wherein the bottom plate has a wear plate affixed on an outer side thereof.

11. The snowplow bucket of claim 10 wherein the forward edge of the bottom plate is defined by an edge of the wear plate.

12. The snowplow bucket of claim 8 wherein the scraper edge is linear.

13. The snowplow bucket of claim 8 wherein the plow member has an upper portion adjacent the top edge of the plow member, which is generally parallel to the bottom plate.

14. The snowplow bucket of claim 8, and further comprising:

a bottom flange fixedly secured to the plow member adjacent the bottom edge of the plow member, and the bottom plate being affixed to the bottom flange.

15. The snowplow bucket of claim 8 wherein the scraper edge is aligned generally vertically under the top edge of the center surface of the plow member.

* * * * *

UNITED STATES PATENT AND TRADEMARK OFFICE

CERTIFICATE OF CORRECTION

PATENT NO. : 6,574,890 B2
DATED : June 10, 2003
INVENTOR(S) : Donald A. Bateman, Jr.

It is certified that error appears in the above-identified patent and that said Letters Patent is hereby corrected as shown below:

Column 5,
Line 35, delete “an”

Column 6,
Line 11, after “bottom” insert -- plate --
Line 14, after “edge” insert -- , the generally planar bottom plate being adapted to extend generally horizontally when the plow member is aligned for use as a snowplow. --

Signed and Sealed this

Eleventh Day of May, 2004

JON W. DUDAS
*Acting Director of the United States Patent and Trademark Office*